US006038742A

United States Patent [19]

Patterson

[11] Patent Number: 6,038,742

[45] Date of Patent: Mar. 21, 2000

[54] SWIVEL CLIP FOR RELEASABLY SECURING PERSONAL ARTICLES

[75] Inventor: Gregory S. Patterson, Morrisville, N.C.

[73] Assignee: Ericsson Inc., Research Triangle Park, N.C.

[21] Appl. No.: 09/253,461

[22] Filed: Feb. 22, 1999

[51] Int. Cl.[7] ..... A44B 21/00; A45F 5/00

[52] U.S. Cl. ..... 24/3.12; 24/3.11; 24/597; 24/665; 24/669

[58] Field of Search ..... 24/3.12, 3.11, 24/575, 597, 665, 669; 224/197

[56] References Cited

U.S. PATENT DOCUMENTS

| | | | |
|---|---|---|---|
| 2,326,558 | 8/1943 | Pelz | 24/3.11 |
| 3,984,191 | 10/1976 | Doty | 24/669 |
| 4,419,794 | 12/1983 | Horton, Jr. et al. | 24/669 |
| 5,347,693 | 9/1994 | Otrusina | 24/3.12 |
| 5,622,296 | 4/1997 | Pirhonen et al. . | |
| 5,839,173 | 11/1998 | Otrusina | 24/597 |

FOREIGN PATENT DOCUMENTS

| | | | |
|---|---|---|---|
| 0135878 | 6/1948 | Australia | 24/665 |
| 0818988 | 8/1959 | United Kingdom | 24/665 |

*Primary Examiner*—Victor N. Sakran
*Attorney, Agent, or Firm*—Woods, Phillips, VanSanten, Clark & Mortimer

[57] ABSTRACT

A clip is provided for releasably securing an article of personal use, the article having a stud with a head spaced from the article. The clip includes a base connectable to a strap and a spring member biased against the base. The base includes a recess hole adapted to receive the stud head. The spring member includes a slot therein extending to an end substantially aligned with the recess hole, with the aligned end of the slot having a first width less than a diameter of the stud head.

24 Claims, 3 Drawing Sheets

SWIVEL CLIP FOR RELEASABLY SECURING PERSONAL ARTICLES

FIELD OF THE INVENTION

The present invention is directed toward devices for securing personal articles and, more particularly, toward a swivel clip for releasably securing personal articles.

BACKGROUND OF THE INVENTION

Swivel-type clips are becoming prevalent for securing personal articles, such as cellular phones, pagers, etc., to the belt of a user. In addition to providing the user with the convenience of not having to carry the article in their hand, purse, etc., the swivel-type clip offers the advantage of allowing the article the freedom to rotate about the clip. Rotation of the article aids in preventing the article from jabbing or sticking uncomfortably into the side of the user. This advantage is especially appreciated when the article being secured is a cellular phone generally having a long slender profile.

In contrast to a belt clip, which is attached to the personal article and removed from the belt along with the personal article, the swivel-type clip is intended to remain secured to the belt of the user. The personal article is attached to, and removed from, the swivel clip. It is generally desired that the interface between the swivel clip and the personal article provide for easy, quick removal.

A typical interface includes an undercut feature in the swivel clip that mates to a feature attached to the personal article. Generally, a slot with undercuts at the sides interfacing with an attachment feature, such as a stud with flanges, provides such an interface. Generally, the stud (and subsequently the personal article) is held within the slot by either (a) a positive locking feature, (b) a passive locking feature, or (c) by the geometry of the stud and slot. As used herein, a passive lock is defined as a lock where the feature being used to secure the article in place is designed to be overcome by supplying sufficient force. Overcoming the force is the only way to disengage the mating condition.

A problem with positive locking features is that they generally require a button, latch, or the like, manually engageable by a user to disengage a post or undercut to allow the article to be removed from the clip. Wear of the moving parts (button, latch, etc.) is a concern since cycles in the 10,000+ range can be expected for the normal life of the product. Also, due to the size limitations for the clip-type products (they are generally desired to be as small as possible), reliability is often an issue. The loads that the clips are subjected to can be surprisingly high. For instance, consider the case where a user attempts to sit in a chair and the article gets caught on the chair arm rest. A 200 lb. user can exert a large amount of force generally far greater than the force capable of being handled by the small latching mechanisms. Finally, moving parts typically means that more parts are required for assembly, which relates directly to the manufacturing cost of the clip.

Geometric locking features are generally not burdened with the limitations of wear, reliability and manufacturing costs associated with positive locking features requiring moving parts. However, geometric locking features do create increased difficulty in easily and/or quickly attaching or removing the article from the clip. The theory behind the geometric locking feature is that in one orientation of the article relative to the clip, the article is permitted to move within or relative to the clip, while in a different orientation, the article and clip are locked together or there is sufficient interference to prevent the article from moving with respect to the clip. Thus, depending on the design of the geometric locking feature, the user must generally rotate the article (90°, 180°, etc.) prior to sliding the article out of the clip, or prior to attaching the article to the clip. The required motion may be considered cumbersome and awkward, especially since preventing the article from accidentally disengaging from the clip requires that the geometric locking feature be such that normal use will not allow the article to detach from the clip.

A problem associated with passive locking features is that, if the passive locking feature is designed with a high enough retaining force to prevent the article from releasing under normal usage, the high force typically makes it difficult for the user to release the article when desired. Conversely, if the force is low enough to allow usability, then it is subject to releasing unexpectedly under normal conditions, thus increasing the chance of the secured article being lost and/or stolen.

Further, a problem related primarily to the positive locking and geometric locking features is that the large size of the securing structure (i.e., moving parts, geometrically shaped parts, etc.) reduces the size of the primary spring utilized to attach the clip to the user's belt, resulting in a spring that is easily deformable and subject to being easily disengaged from the belt of the user.

The present invention is directed toward overcoming one or more of the above-mentioned problems.

SUMMARY OF THE INVENTION

A clip is provided for releasably securing an article of personal use, the article having a stud with a head spaced from the article. The clip includes a base connectable to a strap and a spring member biased against the base. The base includes a recess hole adapted to receive the stud head. The spring member includes a slot therein extending to an end substantially aligned with the recess hole, with the aligned end of the slot having a first width less than a diameter of the stud head.

The slot includes first and second sections, with the first section of the slot having a width tapering from a width greater than the diameter of the stud head to the first width, and the second section having a width substantially equal to the first width and aligned with the recess hole.

The recess hole and stud head may each have a circular shape permitting swiveling or pivoting of the article/stud with the article secured to the clip.

In a first form, the base includes a ramped portion beginning at the recess hole and extending, at an angle, away from the spring member in substantial alignment with the slot in the spring member.

In one aspect of the first form, a first member is connected to the base and spring member, with the first member, base and spring member defining a passage for receiving the strap. The first member, base and spring member are defined as one piece.

In a second form, the base includes a channel formed in a side abutting the spring member and extending to the recess hole. The channel is substantially aligned with the slot in the spring member and has a depth tapering from a maximum depth distal the recess hole to a minimum depth at the recess hole.

In one aspect of the second form, a first member is connected to the spring member and defines a clip releasably securable to the strap. The first member is spaced from the base, with the first member and base defining a passage for receiving the strap.

In another aspect of the second form, the first member is spaced from and extends substantially parallel to the spring member, with the first member and spring member defining a receptacle receiving the base. The base includes a concave surface facing the first member, with the first member and the concave surface of the base defining a passage for receiving the strap.

In yet another aspect of the second form, the first member and spring member are defined as one piece. The first member, base and spring member are connected together by at least one rivet.

In still another aspect of the second form, the spring member is biased against the base in a first position defining a retaining position with the stud head engaging the recess hole and movable relative to the base in a first direction to a second position defining a release position with the stud head disengageable from the recess hole. Movement of the spring member relative to the base in the first direction is restricted via a projection extending from the spring member and a corresponding lip extending from the base while the cooperating lip and projection are not needed for functional purposes, they aid in enhancing the durability of the inventive clip.

With the spring member biased against the base in the first position, the projection and lip are spaced a first distance from one another. With the spring member in the second position, the projection on the spring member engages the lip on the base prohibiting further movement of the spring member relative to the base in the first direction past the second position. To ensure proper operation of the clip, the first distance is greater than an axial length of the stud head.

It is an object of the present invention to provide a clip for securing a personal article capable of securely attaching to a strap associated with a user and including structure positively securing the article to the clip.

It is a further object of the present invention to provide a low cost clip for securing a personal article having a positive locking feature.

It is yet a further object of the present invention to provide a clip for securing a personal article capable of easy and quick attachment/removal of the article to/from the clip.

It is still a further object of the present invention to provide a clip for securing a personal article allowing pivotal movement of the article when secured to the clip.

Other aspects, objects and advantages of the present invention can be obtained from a study of the application, the drawings, and the appended claims.

DETAILED DESCRIPTION OF THE PREFERRED EMBODIMENTS

Figure 1:
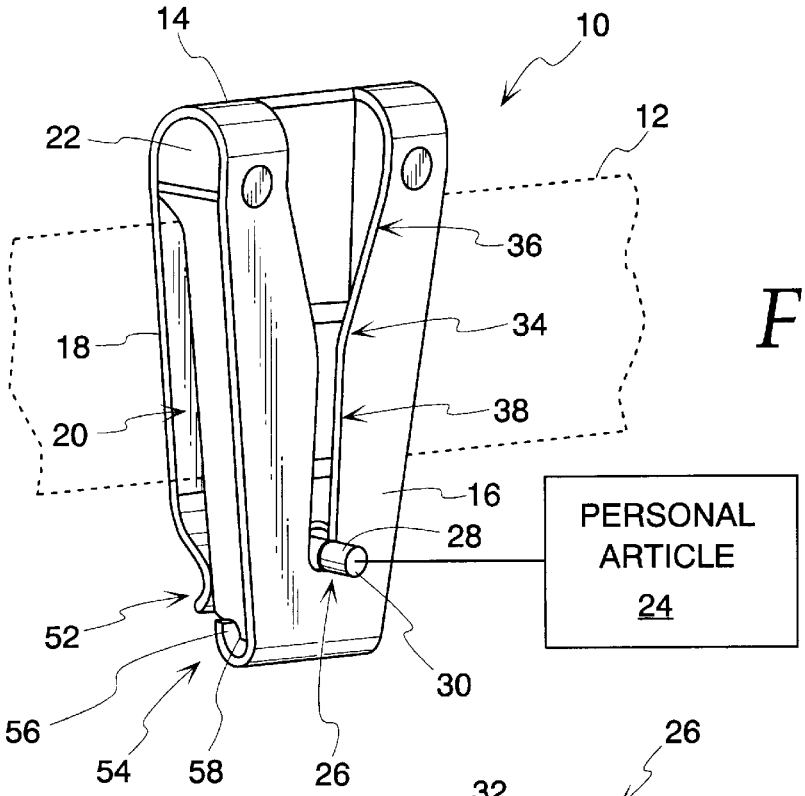
FIG. 1 is a perspective view of a clip according to the present invention.
Figure 2:
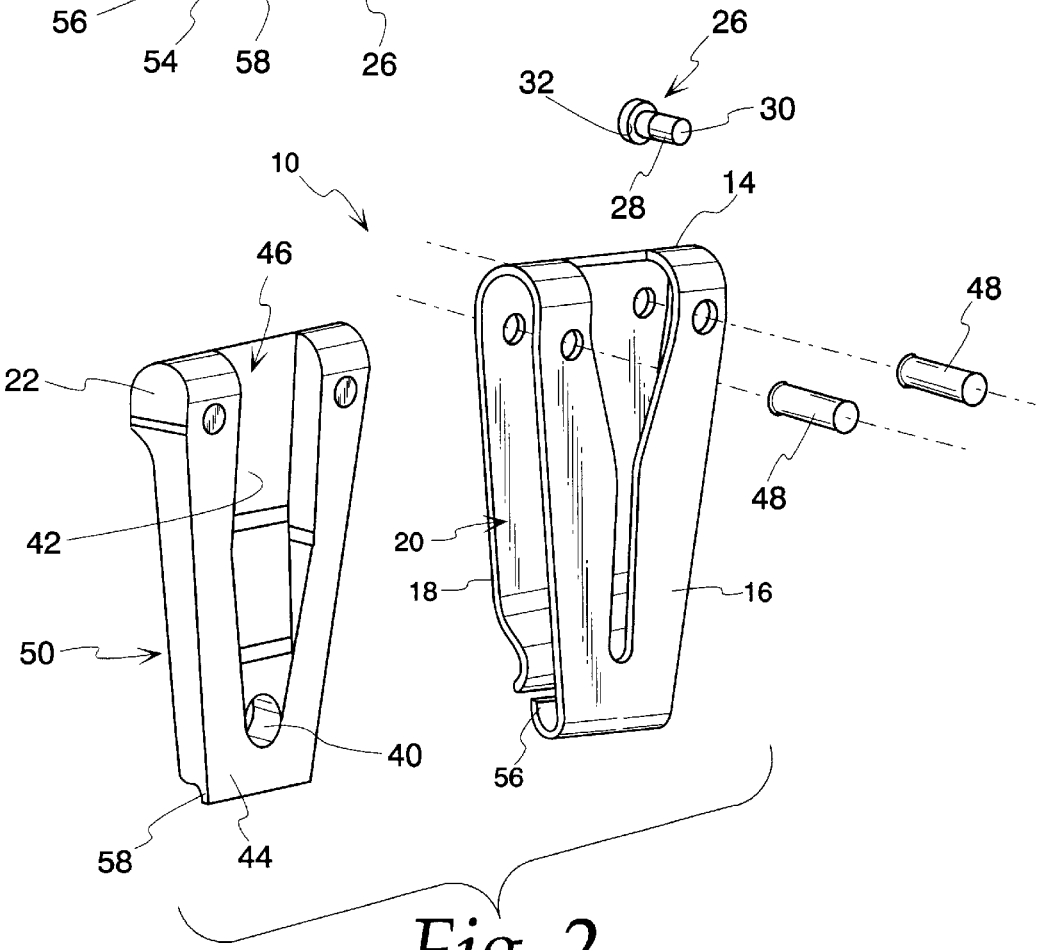
FIG. 2 is an exploded view of the clip shown in FIG. 1.

Referring to FIGS. 1 and 2, a clip, shown generally at 10, is illustrated for securing personal articles. The clip 10 is designed to be carried on a belt 12 of a user. While the clip 10 is described as being attachable to a belt 12, it should be understood that the belt 12 is employed for illustrative purposes only and the clip 10 may be attached to any strap-like structure, such as, but not limited to, articles of clothing, straps, vehicle seat belts, etc. The clip 10 includes a spring element 14 having first 16 and second 18 spaced apart members defining a receptacle 20, and a base 22 received in the receptacle 20. The clip 10 is designed for releasably securing a personal article 24 thereto. The personal article 24 may be virtually any article desired by the user to be releasably secured to the clip 10, and may include such articles as cellular phones, pagers, keys, etc. The personal article 24 includes a stud 26 having a shaft 28 with spaced ends, one end 30 of the shaft 28 attached to the personal article 24, and the other end of the shaft 28 having a head 32.

The first member 16 is biased, via the spring element 14, against the base 22 and includes a slot 34 formed therein. The slot 34 includes a first portion 36 tapering from a second width to a first width, and a second portion 38 having substantially the first width. Preferably, the first width is greater than the diameter of the stud shaft 28 and less than the diameter of the stud head 32.

The base 22 includes a recess hole 40 adapted to receive the stud head 32 and substantially in alignment with the second portion 38 of the slot 34 in the first member 16. A channel 42 is formed in the surface 44 of the base 22 abutting the first member 16. The channel 42 has a depth which tapers from a maximum depth at a portion 46 distal the recess hole 40 to a minimum depth at the recess hole 40. With the base 22 disposed within the receptacle 20, the channel 42 and recess hole 40 are substantially aligned with the slot 34 in the first member 16. The channel 42 and slot 34 together define an undercut slot for receiving the stud head 32. The base 22 is suitably maintained within the spring element 14, for example, by conventional rivets 48.

The base 22 includes a concave surface 50 facing the second member 18. The concave surface 50 of the base 22 and the second member 18 define a passage for receiving the belt 12. The second member 18 includes a distal portion 52 defining a clip-type feature for releasably securing the clip 10 to the belt 12 of a user.

In operation, the head 32 of the stud 26 is inserted in the slot 34 at the first portion 36 having a width large enough to allow the head 32 to pass therethrough. As the stud 26 is slid down the slot 34 and corresponding channel 42, the depth of the channel 42 is continually decreasing causing the first member 16 to be biased away from the base 22 until the stud head 32 reaches the recess hole 40, at which point the first member 16 acts to move the head 32 of the stud 26 into the recess hole 40. Since the width of the second portion 38 of the slot 34 is greater than the diameter of the stud shaft 28 and smaller than the diameter of the stud head 32, the bias force of the first member 16 toward the base 22 traps the stud head 32 in the recess hole 40, thus positively securing the personal article 24 to the clip 10.

Preferably, both the recess hole 40 and the stud head 32 have a circular shape, and accordingly, the personal article 24 is capable of rotation when in the secured position. However, it should be noted that the geometry of the recess hole 40 and stud head 32 can be other than circular if it is desired that the personal article 24 not rotate when in the secured position.

To remove personal article 24 from the clip 10, the user simply pulls the personal article 24 in a direction away from the clip 10. The stud head 32 pulls the first member 16 away from the base 22 to a position wherein the stud head 32 is disengaged from the recess hole 40. The personal article 24, and corresponding stud 26 attached thereto, are then slid back along the length of the slot 34 in the opposite direction and removable from the clip 10 upon the stud head 32 reaching the first portion 36 of the slot 34 which has a width greater than the diameter of the stud head 32.

The clip 10 includes an over travel stop feature, shown generally at 54, preventing the first member 16 from being deformed or damaged during use. The over travel stop feature 54 includes a projection 56 on the first member 16 of the spring element 14 and a corresponding lip 58 extending from the base 22. In the position shown in FIG. 1 (retaining position), the projection 56 is spaced a first distance from the lip 58. During removal of the personal article 24 from the clip 10, the first member 16 is pulled away from the base 22 causing the projection 56 to engage the lip 58. Upon engagement of the projection 56 and lip 58, the first member 16 is prevented from being pulled further away from the base 22, thus aiding in preventing damage or deformation of the first member 16 during removal of the personal article 24 as well as providing positive feedback to a user that the personal article 24 has been pulled out far enough. In order to permit removal of the personal article 24, the distance between the projection 56 and lip 58 with the first member 16 biased against the base 22 should essentially be at least as great as the axial length of the stud head 32.

Figure 5:
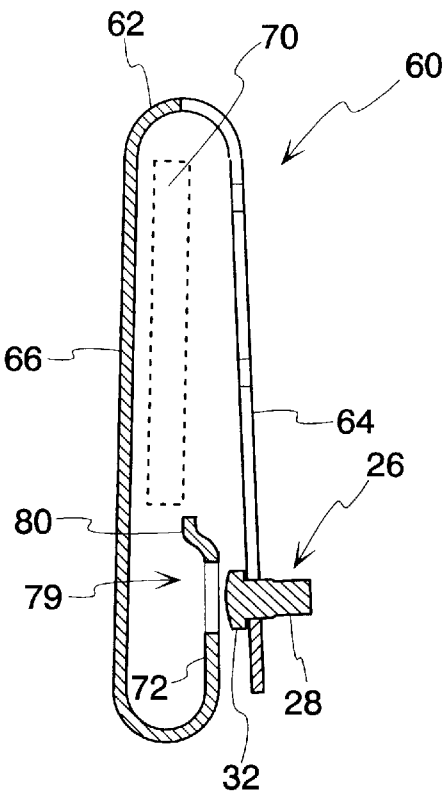
FIG. 5 is a cross-sectional view of the clip shown in FIG. 3 taken along line 4—4, with the clip in a releasing position.
Figure 4:
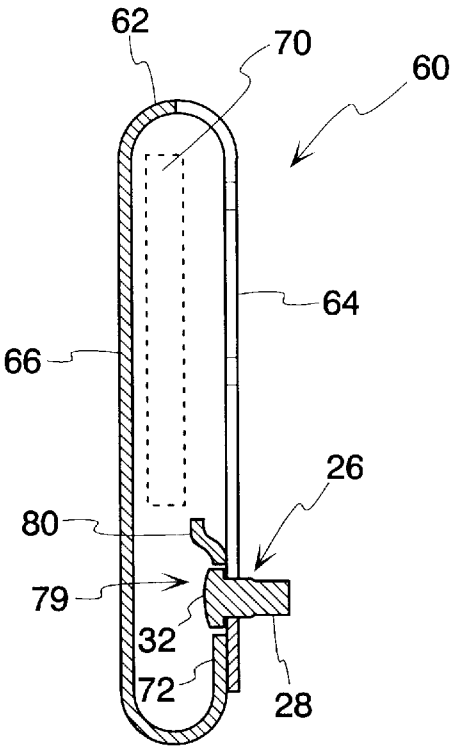
FIG. 4 is a cross-sectional view of the clip shown in FIG. 3 taken along line 4—4, with the clip in a retaining position.
Figure 3:
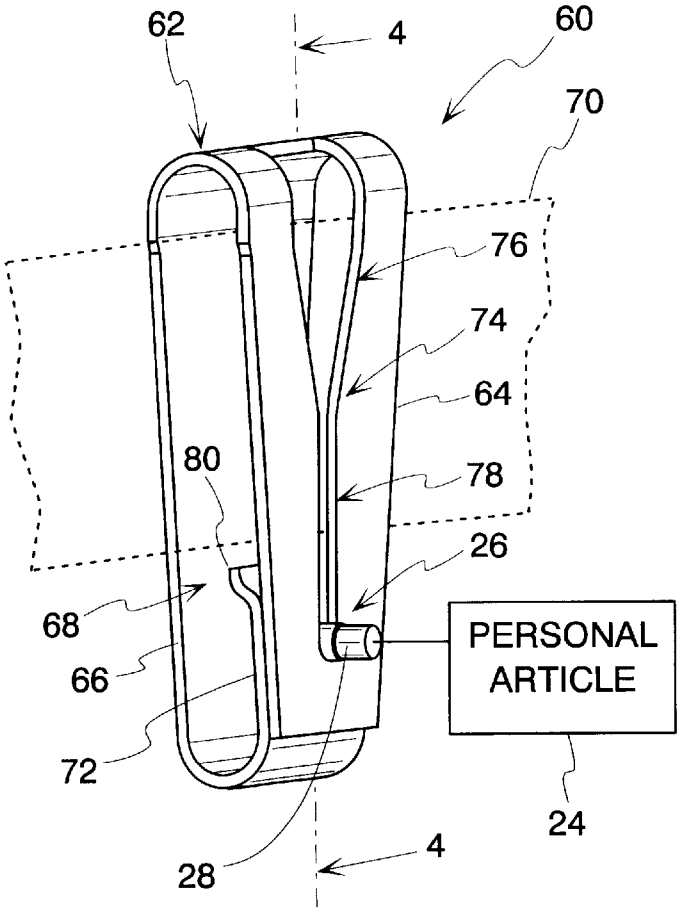
FIG. 3 is a perspective view of a clip for securing a personal article according to a second embodiment of the present invention.

FIGS. 3–5 illustrate a second embodiment of the clip according to the present invention, shown generally at 60. The clip 60 includes a spring element 62 including a first member 64 and a second member 66 spaced from the first member 64, the first 64 and second 66 members defining a passage 68 for receiving a belt 70. A base member 72 extends from the second member 66 into the passage 68 and cooperates with the first 64 and second 66 members in forming the passage 68.

The first member 64 is biased, via the spring element 62, against the base member 72 and includes a slot 74 formed therein. The slot 74 includes a first portion 76 tapering from a second width to a first width, and a second portion 78 having substantially the first width. Preferably, the first width is greater than the diameter of the stud shaft 28 and smaller than the diameter of the stud head 32.

The base member 72 includes a recess hole 79 formed therein adapted to receive the stud head 32 and substantially aligned with the second portion 78 of the slot 74 in the first member 64. The base member 72 includes a ramped portion 80 in alignment with the slot 74 and extending away from the first member 64 so that the head 32 of the stud 26 can move smoothly to the point where it engages with the recess hole 79.

In operation, the head 32 of the stud 26 is inserted in the slot 74 at the first portion 76, having a width large enough to allow the stud head 32 to pass therethrough. The stud 26, which is attached to the personal article 24, is slid down the slot 74 into the second portion 78 which has a width less than the diameter of the stud head 32 but greater than the diameter of the stud shaft 28. As the stud 26 is moved downward in the second portion 78 of the slot 74, the stud head 32 engages the ramped portion 80 of the base member 72 to bias the first member 64 away from the base member 72 to provide clearance for the stud head 32 until it reaches the recess hole 79. The bias force of the first member 64 against the base member 72 moves the stud head 32 into the recess hole 79, trapping it therein to positively secure the personal article 24 to the clip 60.

FIG. 4 is a cross-sectional view taken along line 4—4 in FIG. 3 and illustrates the clip 60 with the stud head 32 engaged and secured within the recess hole 79. In this position, the personal article 24 is secured to the clip 60. The recess hole 79 and stud head 32 may be circular in shape so as to permit pivoting movement of the personal article 24 when secured to the clip 60. However, other geometric configurations of the recess hole 79 and stud head 32 may be utilized.

To remove the personal article 24 from the clip 60, the user grasps and pulls the personal article 24 in a direction away from the clip 60. The stud head 32 pulls the first member 64 away from the base member 72 to the position shown in FIG. 5 where the stud head 32 is completely disengaged from the recess hole 79. At this point, the user may simply slide the personal article 24, and corresponding stud 26 attached thereto, upward along the slot 74 to the first portion 76 where the stud 26, and hence the personal article 24, may be removed from the clip 60.

Figure 8:
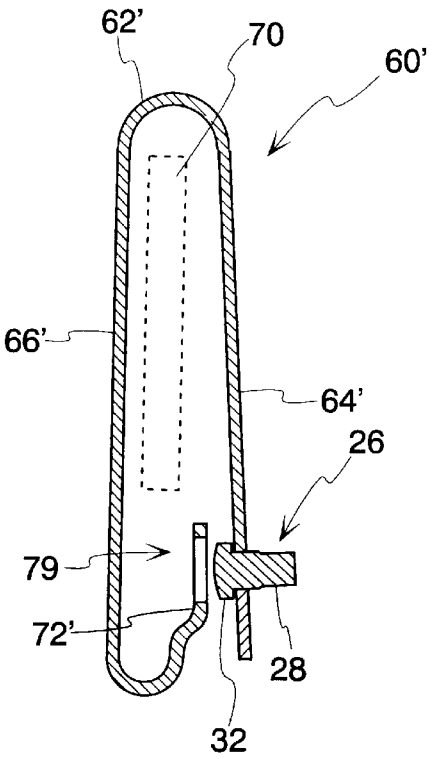
FIG. 8 is a cross-sectional view of the clip shown in FIG. 6 taken along line 7—7, with the clip in a releasing position.
Figure 7:
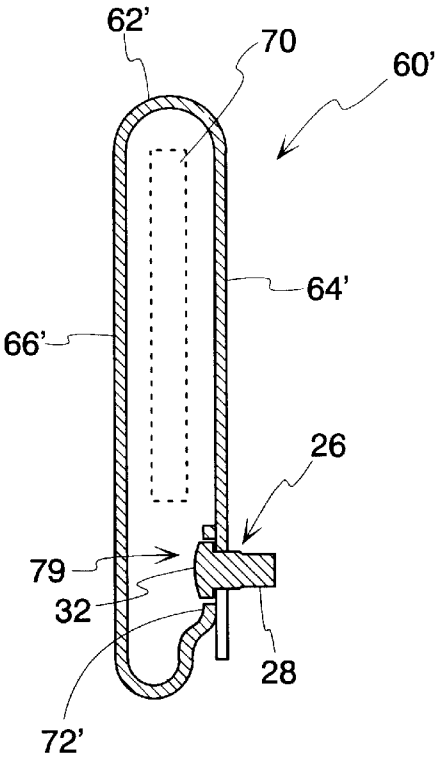
FIG. 7 is a cross-sectional view of the clip shown in FIG. 6 taken along line 7—7, with the clip in a retaining position.
Figure 6:
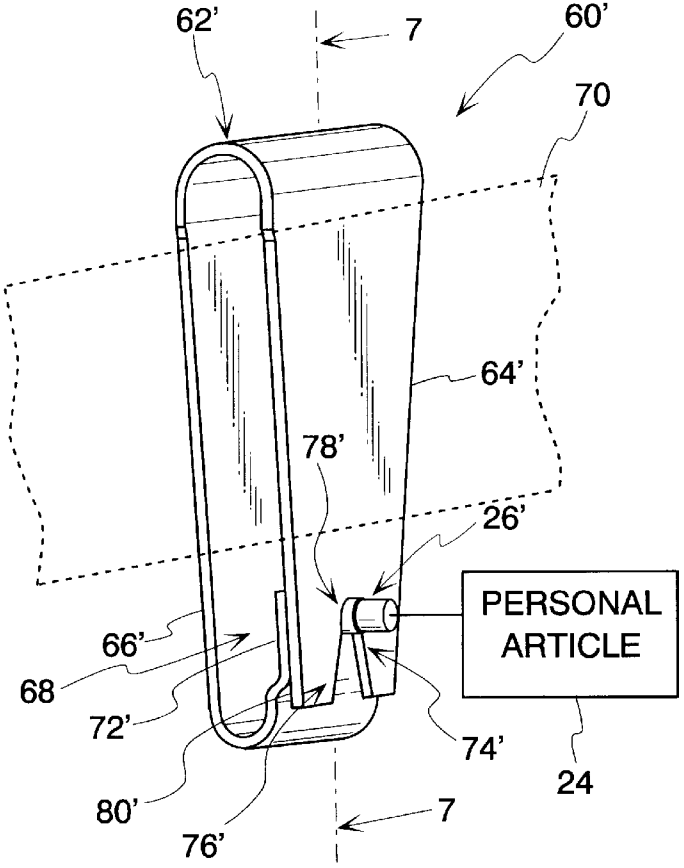
FIG. 6 is a perspective view of a clip for securing a personal article according to a third embodiment of the present invention.

FIGS. 6–8 illustrate, at 60', a variation of the clip 60 shown in FIGS. 3–5, with like elements represented by the same reference numerals and elements requiring slight modification indicated with a prime (').The stud 60' includes a spring element 62' including first member 64' and a second member 66' spaced from the first member 64', the first 64' and second 66' members defining a passage 68 for receiving a belt 70, etc. A base member 72' extends from the second member 66' into the passage 68 and cooperates with the first 64' and second 66' members in forming the passage 68.

The first member 64' is biased, via the spring member 62', against the base member 72' and includes a slot 74' formed therein. The slot 74' includes a first portion 76' tapering from a second width to a first width, and a second portion 78' having substantially the first width. Preferably, the first width is greater than the diameter of the stud shaft 28 and smaller than the diameter of the stud head 32. Alternatively, the slot 74' may be a single tapered slot.

The base member 72' includes a recess hole 79 formed therein adapted to receive the stud head 32 and substantially aligned with the second portion 78' of the slot 74' in the first member 64'. The base member 72' includes a ramped portion 80' in alignment with the slot 74' and extending away from the first member 64' so that the head 32 of the stud 26 can move smoothly to the point where it engages with the recess hole 79.

In operation, the stud head 32 is inserted in the slot 74' at the open end of the first portion 76'. The stud 26 is slid upward into the second portion 78' of the slot 74', which has a width less than the diameter of the stud head 32 but greater than the diameter of the stud shaft 28. As the stud 26 is moved upward, the stud head 32 engages the ramped portion 80' of the base member 72', which causes the first member 64' to be biased away from the base member 72' until the stud head 32 reaches the recess hole 79, at which point the first member 64' acts to move the head 32 of the stud 26 into the recess hole 79. The bias force of the first member 64' against the base member 72' traps the stud head 32 in the recess hole 79, thus positively securing the personal article 24 to the clip 60'.

FIG. 7 is a cross-sectional view taken along line 7—7 in FIG. 6 and illustrates the clip 60' with the stud head 32 engaged and secured within the recess hole 79. In this position, the personal article 24 is secured to the clip 60'.

To release the personal article 24 from the clip 60', the user simply grasps and pulls the personal article 24 in a direction away from the clip 60'. The stud head 32 pulls the first member 64' away from the base member 72' to the position shown in FIG. 8 where the stud head 32 is completely disengaged from the recess hole 79. The user then slides the personal article 24, and corresponding stud 26 attached thereto, downward along the slot 74' to the first portion 76' where the stud 26, and hence the personal article 24, may be removed from the clip 60'.

The present invention, as described above, provides a secure means of attaching a personal article 24, such as a cellular phone, pager, etc., to the clip 10, 60, 60'. Hitting, pushing or pulling on the article 24 at its side will not result in its release but will only drive the stud head 32 against the wall of the recess hole 40, 79. Only by pulling the article 24 away from the user's body (assuming the clip 10, 60, 60' is attached to the user's belt) can the stud head 32 be released from the recess hole 40, 79 and the article 24 subsequently removed from the clip 10, 60, 60'.

The spring element 14, 62, 62' may be made of metal, such as brush stainless, chrome, etc., or plastic. The base 22 may also be made of metal, such as aluminum, etc., or plastic. One skilled in the art will appreciate that the thickness of the spring element 14, 62, 62' is variable depending upon depending upon the material utilized and the spring forces necessary to carry the personal article 24. Further, the rivets 48 may be replaced with other conventional attachment means, such as ultrasonic welding, heat stacking, glue, dimple features in the first member 16 that engage corresponding recesses in the base 22, etc. Finally, a soft durometer overmold material may be placed on the concave surface 50 of the base 22 to further aid in securing the clip 10 to the user's belt, strap, etc.

While the invention has been described with particular reference to the drawings, it should be understood that various modifications could be made without departing from the spirit and scope of the present invention.

I claim:

1. A clip for releasably securing an article of personal use having a stud with a head spaced from the article, said clip comprising:

a base having a recess hole adapted to receive the stud head, the base being connectable to a strap; and a spring member biased against the base, the spring member having a slot therein extending to an end substantially aligned with the recess hole, the aligned end of the slot having a first width less than a diameter of the stud head, the spring member biasing the stud head in the recess hole when the article of personal use is in a secured position.

2. The clip of claim 1, wherein the slot includes a first section having a width tapering from a width greater than the diameter of the stud head to the first width, and a second section having a width substantially equal to the first width with a portion aligned with the recess hole.

3. The clip of claim 1, wherein the recess hole and stud head each have a circular shape.

4. The clip of claim 1, wherein the base includes a channel formed in a side facing the spring member, the channel being substantially aligned with the slot in the spring member and having a depth tapering from a maximum depth distal the recess hole.

5. The clip of claim 1, wherein the base includes a ramped portion aligned with the slot and tapered away from the spring member in the direction away from the recess hole.

6. The clip of claim 1, further comprising a first member connected to the base and spring member, the first member, base and spring member defining a passage for receiving the strap.

7. The clip of claim 6, wherein the first member, base and spring member are defined as one piece.

8. The clip of claim 1, further comprising a first member connected to the spring member, the first member defining a mounting member releasably securable to the strap.

9. The clip of claim 8, wherein the first member is spaced from the base, the first member and base defining a passage for receiving the strap.

10. The clip of claim 8, wherein the first member is spaced from and extends substantially parallel to the spring member, the first member and spring member defining a receptacle receiving the base.

11. The clip of claim 10, wherein a surface of the base facing the first member is concave, the first member and the concave surface of the base defining a passage for receiving the strap.

12. The clip of claim 8, wherein the first member, base and spring member are connected together by at least one rivet.

13. The clip of claim 8, wherein the first member and spring member are one piece.

14. The clip of claim 1, wherein the spring member is biased against the base in a first position defining a retaining position with the stud head engageable in the recess hole and movable relative to the base in a first direction to a second position defining a release position with the stud head disengageable from the recess hole.

15. The clip of claim 14, wherein the spring member includes a projection extending therefrom and the base includes a corresponding lip extending therefrom, the projection and lip adapted to restrict movement of the spring member relative to the base in the first direction.

16. The clip of claim 15, wherein:

the spring member is against the base in the first position with the projection and lip spaced a first distance from one another; and with the spring member in the second position, the projection on the spring member engages the lip on the base prohibiting further movement of the spring member relative to the base in the first direction past the second position.

17. The clip of claim 16, wherein the first distance is greater than an axial length of the stud head.

18. A clip for releasably securing an article of personal use having a stud with a shaft having spaced ends, one end of the shaft attached to the article and the other end of the shaft having a head, said clip comprising:

a spring member including first and second spaced apart members defining a receptacle;

a base in the receptacle and having a recess hole adapted to receive the stud head, the base being connectable to a strap, the spring member biasing the first member against the base;

a slot in the first member extending to an end substantially aligned with the recess hole, the aligned end of the slot having a first width less than a diameter of the stud head and greater than a diameter of the stud shaft; and a channel in a surface of said base facing the first member and extending to the recess hole, the channel substantially aligned with the slot in the first member and having a depth tapering from a maximum depth distal from the recess hole to a minimum depth at the recess hole.

19. The clip of claim 18, wherein the recess hole and stud head each have a circular shape.

20. The clip of claim 18, wherein the second member defines a clip releasably securable to the strap.

21. The clip of claim 18, wherein the second member and base define a passage for receiving the strap.

22. The clip of claim 18, wherein the first member is against the base in a first position defining a retaining position with the stud head within the recess hole, said first member being selectively movable relative to the base in a first direction to a second position defining a release position with the stud head clear from the recess hole.

23. The clip of claim 22, wherein a projection extending from the first member cooperates with a lip extending from the base to restrict movement of the first member relative to the base in the first direction, the second position of the first member defined by engagement of the projection and lip.

24. The clip of claim 23, wherein:

with the first member in the first position, the projection and lip are spaced a first distance from one another; and with the first member in the second position the projection engages the lip to prohibit further movement of the first member relative to the base in the first direction past the second position, the first distance being greater than an axial length of the stud head.

* * * * *